US007043841B2

(12) United States Patent
Franzini et al.

(10) Patent No.: US 7,043,841 B2
(45) Date of Patent: May 16, 2006

(54) SHAVING APPARATUS

(75) Inventors: John Richard Franzini, Hollis, NH (US); David Edward Roche, Nashua, NH (US); Andrew Pennella, Stamford, CT (US); Kenneth A Raymond, Bethany, CT (US)

(73) Assignee: Eveready Battery Co., Inc., St. Louis, MO (US)

( * ) Notice: Subject to any disclaimer, the term of this patent is extended or adjusted under 35 U.S.C. 154(b) by 40 days.

(21) Appl. No.: 10/728,045

(22) Filed: Dec. 4, 2003

(65) Prior Publication Data

US 2005/0120560 A1 Jun. 9, 2005

(51) Int. Cl.
*B26B 21/44* (2006.01)

(52) U.S. Cl. ..... 30/41; 30/535; 30/538

(58) Field of Classification Search ..... 30/41, 30/538, 541, 123.3, 535
See application file for complete search history.

(56) References Cited

U.S. PATENT DOCUMENTS

| | | | | |
|---|---|---|---|---|
| 1,899,841 | A | 2/1933 | Acken | 30/41 |
| 3,053,422 | A | 9/1962 | Tenison | 222/399 |
| 3,703,765 | A | 11/1972 | Perez | 30/41 |
| 3,726,009 | A | 4/1973 | Hackmyer | 30/41 |
| 4,023,269 | A | 5/1977 | Lopez, Jr. | 30/41 |
| 4,077,119 | A | 3/1978 | Sellera | 30/41 |
| 4,177,556 | A | 12/1979 | Galli, Jr. | 30/41 |
| 4,238,882 | A | 12/1980 | Harrison | |
| 4,377,034 | A | 3/1983 | Druash et al. | 30/41 |
| 4,433,483 | A | 2/1984 | Lazarus | 30/41 |
| 4,562,643 | A | 1/1986 | Cataudella | 30/41 |
| 4,753,006 | A | 6/1988 | Howe | 30/41 |
| 4,760,642 | A | 8/1988 | Kwak | 30/123 |
| 4,791,723 | A | 12/1988 | Jacobson | 30/41 |
| 4,809,432 | A | 3/1989 | Schauble | 30/41 |
| 4,813,138 | A | 3/1989 | Chen | 30/41 |
| 4,868,982 | A | 9/1989 | McComas | 30/41 |
| 4,888,868 | A | 12/1989 | Pritchard | 30/41 |
| 4,908,945 | A | 3/1990 | Jacobson | 30/41 |
| 4,974,319 | A | 12/1990 | Maguire, Jr. et al. | 30/41 |
| 5,014,427 | A | 5/1991 | Byrne | 30/41 |
| 5,016,351 | A | 5/1991 | Drahus | 30/41 |
| 5,092,041 | A | 3/1992 | Podolsky | 30/41 |
| 5,103,560 | A | 4/1992 | Podolsky | 30/41 |
| 5,168,628 | A | 12/1992 | Mock et al. | 30/41 |
| 5,234,140 | A | 8/1993 | Demarest et al. | 222/394 |

(Continued)

FOREIGN PATENT DOCUMENTS

| | | | |
|---|---|---|---|
| GB | 640185 | A | 7/1950 |

(Continued)

OTHER PUBLICATIONS

Copy of PCT Search Report for Serial No. PCT/IB03/01144 dated Oct. 29, 2003.
International Search Report, PCT/US2005/004874, Eveready Battery Co., Inc., Nov. 16, 2005.

*Primary Examiner*—Hwei-Siu Payer
(74) *Attorney, Agent, or Firm*—Michaud-Duffy Group LLP

(57) ABSTRACT

A shaving apparatus is provided that includes a razor cartridge, a shaving aid dispenser, and a reservoir operable to contain a non-solid shaving aid material. The shaving aid dispenser includes one or more valves disposed within a contact panel. The contact panel is disposed adjacent the cutting edges of the one or more razor blades. Each of the valves is selectively operable between an open position and a closed position. The valves are operated by the normal force of the contact surface applied to the surface to be shaved. The reservoir is in fluid communication with the selectively operable valves.

20 Claims, 2 Drawing Sheets

U.S. PATENT DOCUMENTS

| | | | | |
|---|---|---|---|---|
| 5,337,478 | A | 8/1994 | Cohen et al. | |
| 5,384,961 | A | 1/1995 | Gregory | 30/41 |
| 5,564,190 | A | 10/1996 | Fleetwood | 30/41 |
| 5,673,485 | A | 10/1997 | Hill | 30/41.5 |
| 5,701,674 | A | 12/1997 | Mitchell | 30/41 |
| 5,761,813 | A | 6/1998 | Frick et al. | 30/41 |
| 5,855,066 | A | 1/1999 | Manger | 30/41 |
| 5,983,500 | A | 11/1999 | da Silva | 30/41 |
| 2002/0023351 | A1 | 2/2002 | Simms | |
| 2005/0138814 | A1* | 6/2005 | Pennella et al. | 30/41 |

FOREIGN PATENT DOCUMENTS

| | | | |
|---|---|---|---|
| GB | 2 246 314 | A | 1/1992 |
| JP | 10-165668 | | 6/1998 |
| JP | 2003210874 | | 7/2003 |
| WO | WO 00 / 10780 | | 3/2000 |
| WO | WO 00 / 47374 | | 8/2000 |
| WO | WO 02 / 32253 | A1 | 4/2002 |
| WO | WO 2004/071260 | A | 8/2004 |
| WO | WO 2005/002809 | A | 1/2005 |

* cited by examiner

SHAVING APPARATUS

BACKGROUND OF THE INVENTION

1. Technical Field

The present invention relates to shaving apparatus in general, and to shaving apparatus having a mechanism for providing a flowable shaving aid material in particular.

2. Background Information

Numerous attempts have been made to combine a razor assembly with a mechanism for dispensing shaving aid material. Typically, the shaving apparatus will include a reservoir containing a shaving aid material and one or more passages connecting the reservoir to a point of discharge. The shaving aid material is picked up by the user at the point of discharge. The shaving aid material is typically forced from the reservoir by pressurized gas, or by mechanical arrangement that decreases the volume of the reservoir.

In some instances, a valve mechanism is disposed within the shaving apparatus proximate the reservoir to prevent discharge of shaving aid material from the reservoir when the razor assembly is not in use. To be commercially successful, the valve mechanism of the shaving apparatus should be easy to operate. It should also be easily manufactured at a low cost. It should also be adaptable for use with a variety of different shaving aid materials.

DISCLOSURE OF THE INVENTION

According to the present invention, a shaving apparatus is provided that includes a razor cartridge, a shaving aid dispenser, and a reservoir operable to contain a non-solid shaving aid material. The razor cartridge includes one or more razor blades, each having a cutting edge. The shaving aid dispenser includes one or more valves disposed within a contact panel. The contact panel is disposed adjacent the cutting edges of the one or more razor blades. Each of the valves is selectively operable between an open position and a closed position. The valves are operated by the normal force of the contact surface applied to the surface to be shaved. The reservoir is in fluid communication with the selectively operable valves.

According to an aspect of the present invention, a shaving aid material dispenser is provided. The shaving aid dispenser includes one or more valves disposed within a contact panel, and a reservoir. Each of the valves is selectively operable between an open position and a closed position. The valves are operated by the normal force of the contact surface applied to the surface to be shaved. The reservoir is in fluid communication with the selectively operable valves.

An advantage of the present invention is that a shaving aid material dispenser is provided that actuates automatically during the shaving process. The one or more valves operate from a closed position to an open position when the user applies the shaving apparatus to the surface to be shaved. Hence, the shaving aid material exits, and is therefore applied, only during the shaving process. Once the contact panel is moved out of contact with the surface, the valves are closed, thereby stopping the flow of shaving aid material.

Another advantage of the present invention is that in addition to selectively regulating the flow of shaving aid material, the one or more valves also meter and distribute the flow of shaving aid material.

These and other objects, features, and advantages of the present invention will become apparent in light of the detailed description of the present invention.

DETAILED DESCRIPTION OF THE INVENTION

Figure 1:
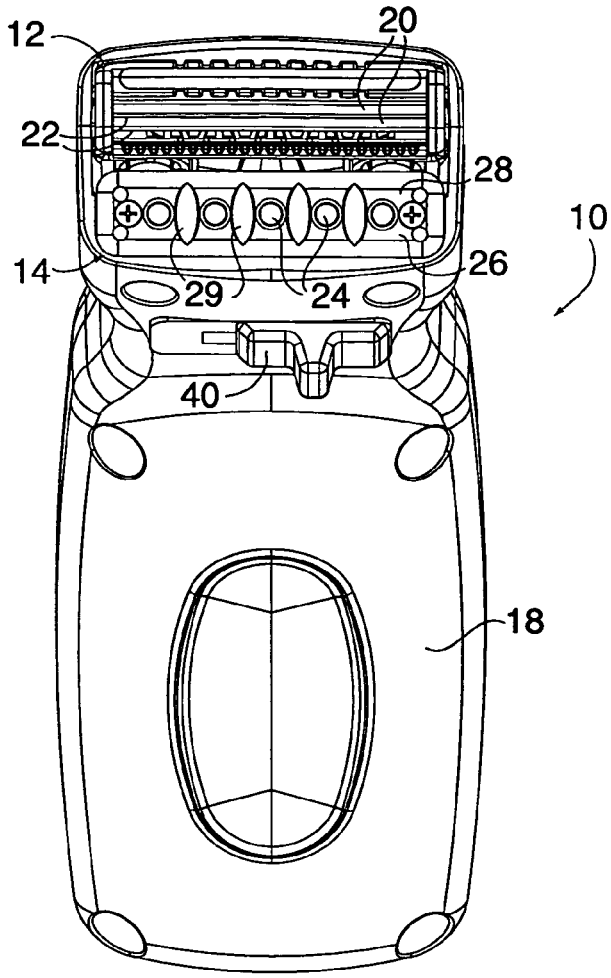
FIG. 1 is a diagrammatic isometric view of an embodiment of the present invention shaving apparatus.

Referring now to FIGS. 1–9, the shaving apparatus 10 includes a razor cartridge 12, a shaving aid dispenser 14, a reservoir 16 (see FIG. 3), and a handle 18.

The razor cartridge 12 includes one or more razor blades 20 attached to a frame. Each razor blade has a cutting edge 22. The razor cartridge 12 can be fixedly or pivotally attached to the handle 18. A variety of different razor cartridges can be used with the present shaving apparatus 10, including those that are intended to be disposable. The present apparatus is not, therefore, limited to any particular type of razor cartridge 12.

The shaving aid dispenser 14 includes one or more selectively operable valves 24. The valves 24 may be disposed within, or may partially or completely form, a contact panel 26 disposed adjacent the razor cartridge 12. The contact panel 26, which includes a contact surface 28, may be continuous around the razor cartridge 12. The contact surface 28 may be planar or may include protruberances 29. In some embodiments, the contact panel 26 may be one or more sections that are disposed adjacent the razor cartridge 12; e.g., the contact panel 26 shown in FIGS. 1 and 2 disposed forward of the razor cartridge 12. Other embodiments of the contact panel 26 may be disposed aft of the razor cartridge 12, or on one or both sides of the razor cartridge 12, or some combination thereof.

Referring to FIGS. 4–9, each of the valves 24 is selectively operable between an open position and a closed position. In the open position (e.g., see FIG. 7), a passage 30 is created for shaving aid material to flow through the valve 24 under normal conditions. In the closed position (e.g., see FIGS. 5 and 6), the passage 30 is eliminated and consequently no appreciable amount of shaving aid material flows through the valve 24 under normal conditions. In preferred embodiments, each of the valves 24 include a male portion 32 and a female portion 34 that mates with one another to form a seal when the valve 24 is in a closed position. In the embodiments shown in FIGS. 4–8, the female portion 34 of each valve 24 is disposed within the contact panel 26. In the embodiment shown in FIG. 9, the male portion 32 of each valve 24 is formed within the contact panel 26, and a member 35 disposed below the contact panel 26 forms the female portion 34 as will be described below. In the embodiment shown in FIGS. 5 and 7, the male and female portions 32,34 have mating conical sections that seal when the male portion 32 is inserted within and in contact within the female portion 34. In the embodiment shown in FIGS. 6 and 8, the mating male and female portions 32,34 of the valves 24 are at least partially spherical. A variety of mating shapes can be used for the sealing surfaces. At least one of the male or female portions 32,34 is positioned to contact the surface to be shaved.

Figure 7:
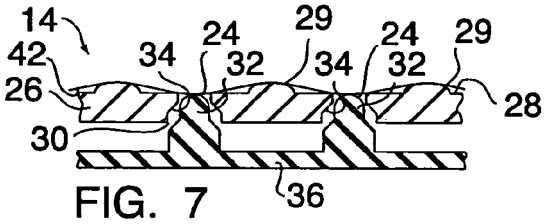
FIG. 7 shows the shaving aid dispenser of FIG. 5 with the valve embodiment applied against a surface to be shaved and the valve in an open position.
Figure 9:
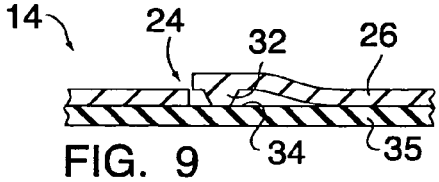
FIG. 9 is a sectional diagrammatic view of a portion of the present invention shaving aid dispenser, illustrating a valve embodiment.
Figure 8:
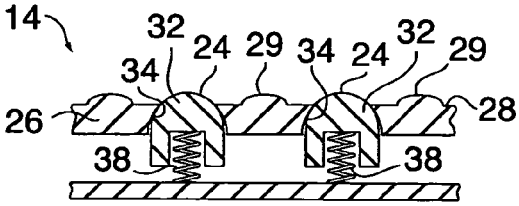
FIG. 8 is a sectional diagrammatic view of a portion of the present invention shaving aid dispenser, illustrating a valve embodiment.
Figure 9A:
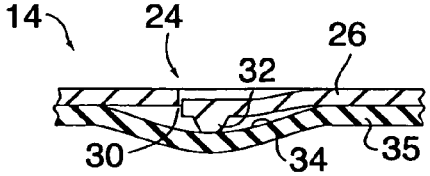
FIG. 9A is a sectional diagrammatic view of a portion of the present invention shaving dispenser, illustrating the valve embodiment shown in FIG. 9 in an open position.

The valves 24 can operate independently of one another, or can operate in concert; e.g., in a manner wherein operating one valve 24 causes one or more other valves 24 to operate at least partially. In the embodiments shown in FIGS. 5–7, each male portion 32 is attached to a support member 36. Pushing on a male portion 32 that is attached to a relatively stiff support member 36 will cause one or more of the adjacent male portions 32 to depress at least partially, thereby opening the adjacent valves 24. Alternatively, pushing on a male portion 32 that is attached to a relatively flexible support member 36 will not cause adjacent male portions 32 to depress at least partially, and the adjacent valves 24 will remain closed. The embodiment shown in FIG. 8 illustrates an embodiment utilizing independent valves 24 with independent biasing elements 38. In the embodiments shown in FIGS. 4–8, each male portion 32 extends up through a female portion 34 to form a valve 24. In the embodiment shown in FIGS. 9 and 9A, the male portion 32 is attached to the contact panel 26 and the female portion 34 is formed when the member 35 disposed contiguous with the contact panel 26 is deflected to form an opening (open position shown in FIG. 9A). The present invention is not limited to the aforesaid illustrative embodiments.

Figure 5:
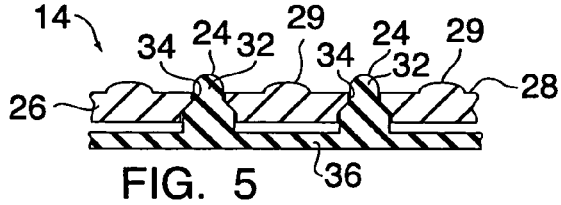
FIG. 5 is a sectional diagrammatic view of a portion of the present invention shaving aid dispenser, illustrating a valve embodiment.
Figure 6:
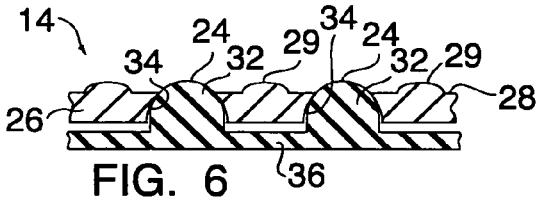
FIG. 6 is a sectional diagrammatic view of a portion of the present invention shaving aid dispenser, illustrating another valve embodiment.

The one or more valves 24 are preferably biased in the closed position. A support member 36 (e.g., as shown in FIGS. 5–7) comprising an elastomeric material is an example of a means for biasing the portions of that valve 24 in the closed position. The elasticity of the support member 36 is such that a desirable amount of force applied against the exposed part of the male portion 32 overcomes the biasing force of the elastic support member 36, thereby permitting the valve 24 to actuate from a closed position to an open position. Biasing means other than the above-described elastomeric embodiment may be used alternatively; e.g., the independent biasing elements 38. As a further example, the member 35 disposed below the contact panel 26 in FIG. 9 may be elastomeric.

The one or more valves 24 are preferably positioned in a pattern selected to provide a desirable distribution of shaving aid material. In the embodiment shown in FIG. 2, for example, the valves 24 are uniformly disposed in a contact panel 26 disposed forward of the razor cartridge 12. The flow rate and distribution of the shaving aid material from the valves 24 can be adjusted to suit the application at hand by adjusting the number of valves 24 within a pattern and the flow through the individual valves 24. Flow through individual valves 24 is selectively chosen to accommodate the physical properties (e.g., viscosity) of the shaving aid material for a predetermined set of application parameters (e.g., temperature, surface moisture, etc.). For those valve 24 embodiments that include mating male and female portions 32,34, a variety of different flow rate profiles can be produced by selectively matching the geometries of the mating portions 32,34. For example, conical shaped mating surfaces 32,34 may produce a linear increase in flow rate through the valve 24 as the mating portions separate from one another. Other mating surface geometries may produce a stepped, or an exponential, increase in flow through the valve 24 as the mating surfaces separate from one another. The present invention valves 24 are not, therefore, limited to any particular mating geometry configuration.

The reservoir 16 for containing the non-solid shaving aid material is in fluid communication with the selectively operable valves 24. The fluid communication between the reservoir 16 and the valves 24 permits non-solid shaving aid material within the reservoir 16 to pass from the reservoir 16 to the valves. The reservoir 16 is not limited to any particular configuration. In some embodiments, the reservoir 16 is not intended to be separated from the handle 18. In these embodiments, the reservoir 16 may be a refillable. In other embodiments, the reservoir 16 may be a replaceable item independent of the handle 18, or disposable as part of a replaceable handle 18.

Figure 2:
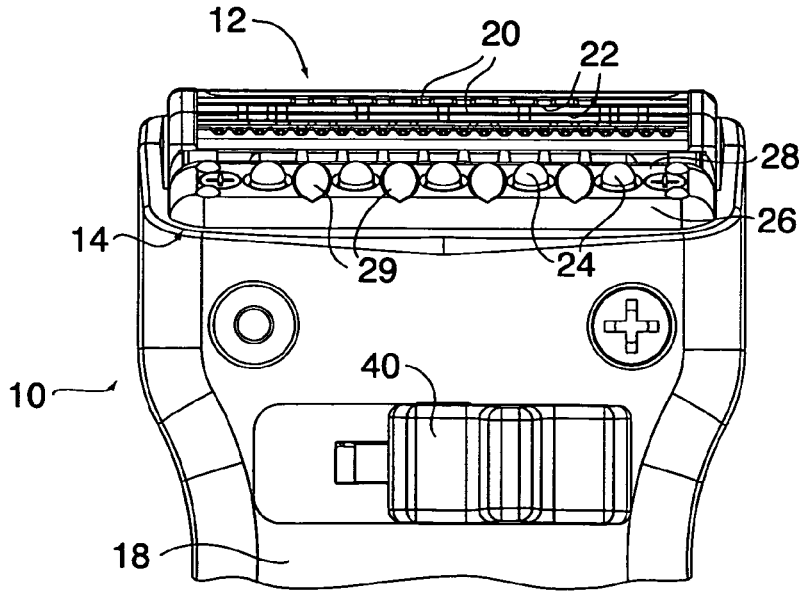
FIG. 2 is an enlarged view of the embodiment shown in FIG. 1.
Figure 3:
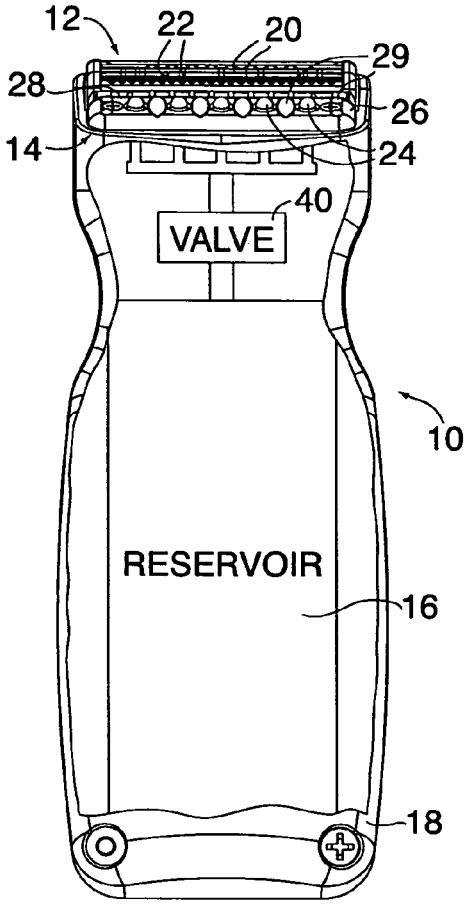
FIG. 3 is a partially sectioned diagrammatic view of a shaving apparatus.
Figure 4:
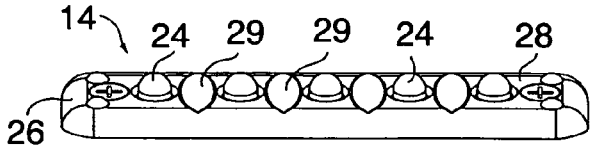
FIG. 4 is a diagrammatic view of a portion of the present invention shaving aid dispenser.

In the embodiment shown in FIGS. 1–3, the shaving apparatus 10 further includes a flow valve 40 disposed between the reservoir 16 and the one or more valves 24. The flow valve 40 is a two-position valve, on and off, that is operable to prevent fluid flow between the reservoir 16 and the one or more valves 24.

In the operation of the invention, the shaving apparatus 10 includes a volume of shaving aid material disposed within the reservoir 16 under pressure. A variety of different mechanisms can be used to create the pressure necessary to force the material out through the valves 24, and the present invention is not limited to any particular mechanism. The user applies the shaving apparatus 10 to the surface 42 (see FIG. 7) to be shaved with a typical amount of normal force, and strokes the shaving apparatus 10 across the surface 42. When the shaving apparatus 10 is applied to the surface 42 to be shaved during normal operation, at least a part of the contact panel 26 and at least one of the valves 24 is placed in contact with the surface 42. When the valve(s) 24 is placed in contact with the surface 42, the normal force applied to the contact panel 26 and valve 24 changes the valve 24 from a closed position to an open position; i.e., at least one of the mating male and female portions 32,34 is moved relative to the other to create a passage 30 through the valve. In the embodiment shown in FIG. 9, the normal force applied to the contact panel 26 and the male portions 32, causes one or more of the male portions 32 to move the member 35 away from the contact panel 26, thereby creating a passage 30 therebetween. In the open position, pressurized shaving aid material from the reservoir 16 flows through the valve passage 30 and is applied to the surface being shaved. Once the normal force is removed, the valve 24 returns to the closed position (i.e., the passage 30 is closed) and the flow of shaving aid material there through is ceased.

The present invention shaving aid dispenser 14 has been described above as an element within a shaving apparatus 10 having a handle 18. According to an aspect of the present invention, the shaving aid dispenser 14 is a portion of a replaceable cartridge that can be selectively attached and removed from a shaving apparatus. When all the usable shaving aid material has been withdrawn from the cartridge, the empty cartridge can be removed from the shaving apparatus 10 and replaced with a new or refilled cartridge.

Although this invention has been shown and described with respect to the detailed embodiments thereof, it will be understood by those of skill in the art that various changes may be made and equivalents may be substituted for elements thereof without departing from the scope of the invention. For example, the embodiments of the present invention described above include one or more valves 24, each having a male portion 32 that moves relative to the female portion 34 to open the valve. In alternative embodiments, the female portion could move relative to the male portion 32 to open the valve.

What is claimed is:

1. A shaving apparatus, comprising:

a razor cartridge having one or more blades, each having a cutting edge;

a shaving aid dispenser, comprising, a contact panel disposed adjacent the cutting edges of the one or more blades, and one or more valves disposed within the contact panel, a flow passage of each of the valves being defined by an aperture extending through the contact panel, wherein each of the valves is selectively operable between an open position and a closed position; and a reservoir for containing a non-solid shaving aid material, wherein the reservoir is in fluid communication with the one or more valves.

2. The shaving apparatus of claim 1, wherein each of the one or more valves includes a male portion and wherein the flow passage of each valve is a female portion, the male and female portion being shaped to mate with one another.

3. The shaving apparatus of claim 2, wherein the male portion and female portion include substantially conical sealing surfaces that are shaped to mate with one another.

4. The shaving apparatus of claim 2, wherein the male portion and female portion include substantially spherical sealing surfaces that are shaped to mate with one another.

5. The shaving apparatus of claim 2, wherein the shaving apparatus includes more than one valve, and wherein the male portions of each of the valves is independent of the male portions of each of the other valves.

6. The shaving apparatus of claim 5, wherein the male portion of each valve is biased into contact with the female portion of that valve.

7. The shaving apparatus of claim 2, further comprising a support member, wherein the malt portions of the one or more valves are attached to the support member.

8. The shaving apparatus of claim 7, wherein the support member comprises an elastomeric material.

9. The shaving apparatus of claim 2, wherein the shaving apparatus includes more than one valve, and wherein all of the valves operate in concert between the open position and the closed position.

10. The shaving apparatus of claim 2, wherein the one or more valves are biased in the closed position.

11. The shaving apparatus of claim 10, wherein in the closed position, the male portions are received within the female portions and the male portions extend partly above the contact panel.

12. The shaving apparatus of claim 2, wherein the male portions are formed within the contact panel.

13. The shaving apparatus of claim 1, wherein the one or more valves are biased in the closed position.

14. A shaving apparatus, comprising:

a razor cartridge having one or more blades, each having a cutting edge;

a shaving aid dispenser, comprising, a contact panel disposed adjacent the cutting edges of the one or more blades, and one or more valves disposed within the contact panel, wherein each of the valves is surrounded by the contact panel and is selectively operable from a closed position to an open position by applying a normal force to the contact panel that is sufficient to operate the razor cartridge; and a reservoir for containing a non-solid shaving aid material, wherein the reservoir is in fluid communication with the one or more valves.

15. The shaving apparatus of claim 14, wherein each of the one or more valves includes a male portion and a female portion that mate with one another.

16. The shaving apparatus of claim 15, wherein the male portion of each valve is biased into contact with the female portion of that valve.

17. The shaving apparatus of claim 16, further comprising a support member, wherein the male portions of the one or more valves are attached to the support member.

18. The shaving apparatus of claim 17, wherein the support member comprises an elastomeric material.

19. The shaving apparatus of claim 14, wherein the shaving apparatus includes more than one valve, and wherein at least two valves operate in concert between the open position and the closed position.

20. The shaving apparatus of claim 14, wherein the one or more valves are biased in the closed position.

* * * * *